US009315293B2

(12) United States Patent
Vucich

(10) Patent No.: US 9,315,293 B2
(45) Date of Patent: Apr. 19, 2016

(54) COMBINATION DOSING CHASER DEVICE

(71) Applicant: Christina Lynn Vucich, Morrisville, NC (US)

(72) Inventor: Christina Lynn Vucich, Morrisville, NC (US)

( * ) Notice: Subject to any disclaimer, the term of this patent is extended or adjusted under 35 U.S.C. 154(b) by 111 days.

(21) Appl. No.: 14/175,458

(22) Filed: Feb. 7, 2014

(65) Prior Publication Data

US 2015/0223624 A1 Aug. 13, 2015

(51) Int. Cl.

| | |
|---|---|
| ***B65D 77/00*** | (2006.01) |
| ***B65D 25/24*** | (2006.01) |
| ***B65D 25/04*** | (2006.01) |
| ***B65D 25/52*** | (2006.01) |
| ***A47G 19/22*** | (2006.01) |
| ***A61J 7/00*** | (2006.01) |

(52) U.S. Cl.

CPC ..... *B65D 25/24* (2013.01); *A47G 19/2205* (2013.01); *A61J 7/0046* (2013.01); *B65D 25/04* (2013.01); *B65D 25/52* (2013.01)

(58) Field of Classification Search

CPC ..... B65D 1/04; B65D 1/24; B65D 25/04; B65D 25/52; A47G 19/2227; A47G 19/2266; A47G 19/2205

USPC ..... 206/217, 459.5, 459.1; 215/6, 365, 387, 215/390, DIG. 7; 220/575, 592.16, 592.17, 220/592.18, 483, 501, 62.12, 23.89, 23.83, 220/23.8; 222/82, 129

See application file for complete search history.

(56) References Cited

U.S. PATENT DOCUMENTS

| | | | | |
|---|---|---|---|---|
| D316,449 | S | 4/1991 | D'Aquino et al. | |
| 5,381,901 | A * | 1/1995 | Hundley | 206/457 |
| 5,878,908 | A * | 3/1999 | Foley | 220/575 |
| D409,442 | S | 5/1999 | Kilpatrick et al. | |
| 6,502,715 | B2 * | 1/2003 | Miorelli | 220/719 |
| 7,165,697 | B1 | 1/2007 | Checkalski | |
| 7,523,840 | B2 * | 4/2009 | Mansfield et al. | 220/506 |
| 8,337,073 | B2 * | 12/2012 | Roberts | 366/130 |
| 8,641,891 | B1 | 2/2014 | Crowder | |
| 2004/0232153 | A1 | 11/2004 | Pietrobon | |
| 2006/0021986 | A1 | 2/2006 | Mansfield et al. | |
| 2007/0082525 | A1 | 4/2007 | Whidden | |
| 2012/0080436 | A1 * | 4/2012 | Shumaker et al. | 220/501 |

FOREIGN PATENT DOCUMENTS

| | | | |
|---|---|---|---|
| CN | 201727244 | U | 2/2011 |
| EP | 1990284 | A1 | 11/2008 |
| GB | 2370218 | A | 6/2002 |
| JP | 2003175973 | A | 6/2003 |
| KR | 20120007187 | A | 1/2012 |

OTHER PUBLICATIONS

PCT Written Opinion of the International Searching Authority for International Application No. PCT/US2015/14822, International Filing Date Feb. 6, 2015.

* cited by examiner

*Primary Examiner* — Jacob K Ackun
*Assistant Examiner* — Rafael Ortiz
(74) *Attorney, Agent, or Firm* — James G. Passé; Passé Intellectual Property, LLC

(57) ABSTRACT

The present invention is a device for placing two separate liquids in separate compartments and when the device is tipped the two liquids are delivered in succession. First liquid compartment is positioned inside or next to the second liquid compartment with lips positioned to achieve proper delivery.

15 Claims, 4 Drawing Sheets

COMBINATION DOSING CHASER DEVICE

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to a device for delivering a dose of a liquid followed by a chaser of a second liquid. Specifically, it relates to a dosing/chaser device that delivers a first liquid then only after the first dose is delivered, delivers a second liquid all in one drinking motion.

2. Description of Related Art

The use of a chaser, that is, a second drink taken right after a first drink, has long been utilized for a variety of different purposes; specifically when the two liquids are not to be mixed before or during the drinking process. Classic examples are a chaser of beer immediately after a shot of hard liquor and a chaser of water immediately after drinking something distasteful like medicine. The matching of liquids is frequently a smaller drink followed by a larger drink but in general refers to two drinks taken in immediate quick succession.

The faster the succession of liquids, the more difficulty this creates with two glasses since the first liquid container or glass must be put down and the second one picked up before the succession of drinks can be accomplished. A small number of approaches have been attempted to solve this problem by delivering two liquids in one glass. In one approach a glass is merely divided in two with a wall. This keeps the liquids divided, but as the glass is tipped the two liquids are delivered essentially together rather than in succession. Another approach is a glass with a narrowing in the middle. One liquid is placed in the bottom up to the neck and the other on top. Mixing is minimized but still occurs by the narrowing neck; as the glass is tipped more and more mixing occurs. Drinking must be slow and careful. In general, it does not keep the two drinks perfectly in succession and 20% or more mixing occurs.

There is still a need to design a glass that delivers two separate liquids in succession without mixing of the two during the addition of the separate liquids to the glass or in the process of tipping the glass one time and drinking the liquids in succession.

BRIEF SUMMARY OF THE INVENTION

The present invention relates to the discovery that a two compartment container wherein a first liquid is positioned in a tilted first compartment and a second liquid is positioned in a second compartment surrounding the first. This allows delivery of a first liquid and a second liquid in succession from a single tilt of the container.

Accordingly, in one embodiment of the invention there is a drink container for delivering a first and second liquid in succession to a user in a single tipping motion comprising:

a) a dispensing lip;

b) a first liquid compartment for containing the first liquid, the compartment positioned behind the dispensing lip having a first top opening with a first top opening edge, the edge positioned in height below the dispensing lip for dispensing the first liquid to the dispensing lip;

c) a second liquid compartment for containing the second liquid, the compartment positioned at least partially surrounding the first liquid compartment and having a second top opening with a second top opening edge positioned behind the first opening edge and in height between the dispensing lip and the first top opening edge;

d) an indicator to indicate the maximum amount of liquid to place in the second liquid compartment to insure that the first liquid empties from the first liquid compartment at the dispensing lip before the second liquid begins to empty from the second liquid compartment.

In another embodiment of the present invention there is a drink container for delivering a first and second liquid in succession to a user in a single tipping motion comprising:

a) a dispensing lip;

b) a first liquid compartment positioned inside the container for containing the first liquid, the compartment positioned below the dispensing lip and formed by an inner wall of the container and a connected lip positioned at least partially circumferentially to the inner wall; and c) a second liquid compartment positioned inside of the container in fluid communication with the fluid compartment when the container is tilted for delivery of the first liquid.

DETAILED DESCRIPTION OF THE INVENTION

Figure 1:
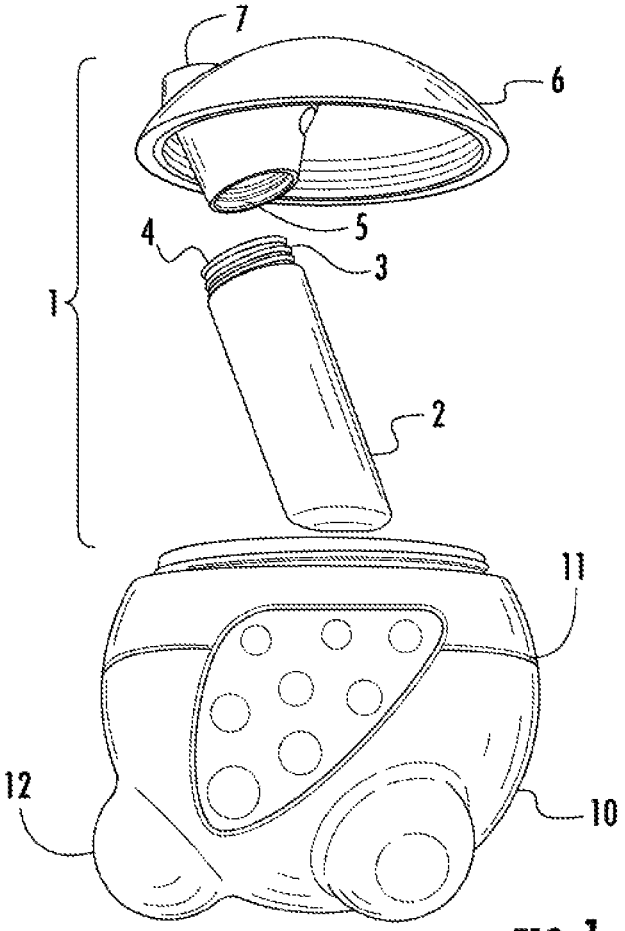
FIG. 1 is an exploded view of an embodiment of the present invention.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and "essentially" mean ±10 percent.

The terms "a" or "an", as used herein, are defined as one or as more than one.

The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "container" or "drink container" refers to a device designed for holding two liquids and deliver a first and second liquid in succession to a user in a manner that the first drink is completely delivered before the second begins. The delivery is done in one drinking motion (i.e. tip of the glass). As disclosed above the container contains a first liquid and a second liquid chaser. Any two liquids are intended. For example a medicine and water, a first and second medicine, a first and second drink (alcoholic or not), a first drink followed by water and the like. While typically, the first liquid is less volume than the second (e.g. a shot and a beer), there is no requirement other than the delivery of two liquids in succession. A user then is anyone who would use the container to deliver the two liquids in succession in one motion. The container would be designed such that the first and second liquid are delivered in succession in a single tipping motion. One would consider drinking from a cup where the liquid is delivered to a user by tipping the cup more and more till the liquid is gone. Likewise, the design of the container is such that as the container is tipped the first liquid is delivered and once delivered further tipping allows the delivery of the second liquid; all this occurs in a single tipping motion. The container should be designed in one embodiment to be free standing without tipping over. In one embodiment, the container has feet e.g. on the bottom of the second liquid compartment. In one embodiment, there is a cap for covering one or both of the first and second liquid compartments.

The container of the present invention can be made of any material compatible with liquids and for user (a human) consumption; for example, plastics, metals, resins, ceramics and the like can all be utilized. In one embodiment, the plastic is a polymer such as rigid or foam polystyrene. One skilled in the art of making this container with these materials would use the skill in the art to manufacture a one piece or multi-piece container.

As used herein a "dispensing lip" refers to an edge of the container where the user places their mouth when the container is tipped and the liquid leaves the container. For example, the purpose of the lip of a regular drinking cup or the like would be considered a dispensing lip. It will have a particular height on the container designed as the position for the user to drink from. The dispensing lip could be in the cap or elsewhere on the container.

As used herein a "first liquid compartment" is a space or chamber or the like designed to hold the first liquid. Since the first liquid can begin dispensing when the container is first tipped, in general, the first liquid compartment can be filled to any level. The first liquid compartment is positioned behind the dispensing lip and positioned/designed to deliver the liquid to the dispensing lip. It will have a first top opening edge where liquid exits the compartment. In some embodiments, the top opening edge can also be the dispensing lip. In one embodiment the first compartment is angled toward the dispensing lip. In one embodiment, the first container has an indicator to indicate the maximum amount of liquid to be placed in the compartment.

As used herein the "second liquid compartment" is a space or chamber or the like designed to hold the second liquid. Since the first liquid must be delivered before the second liquid begins dispensing, the second liquid compartment must have a maximum amount of liquid in it. This can be controlled by having an indicator of the maximum amount of liquid to place in the second liquid compartment or next to the first compartment. One way of doing this is to have an indicator line as shown in the figures. In at least one embodiment, the second liquid compartment is positioned at least partially surrounding the first liquid compartment. In another is it positioned below the first compartment. In one embodiment, it will have a second top opening for delivering the second liquid to the dispensing lip having an edge positioned behind the first opening edge and in height between the dispensing lip and the first top opening edge. In one embodiment, the second liquid compartment entirely surrounds the first liquid compartment sides, for example, as shown in the embodiment in the figures. In one embodiment, the second top opening is about perpendicular to the first top opening. In one embodiment there is a second compartment delivering the liquid to the same lip. In one embodiment the first and second compartment are detachable. In one embodiment these are a separated by a flexible joint.

Now referring to the Figures, FIG. 1 is an exploded view of an embodiment of the invention where the first liquid is less in volume than the second liquid. In this view the container 1 comprises a first liquid compartment 2 which is mounted at a tilted angle to upright. The first liquid compartment 2 has top threaded teeth 3 and has a first top opening edge 4. The first liquid compartment 2 screws in to matching teeth 5 of cap 6. For delivery of a first liquid placed inside the first liquid compartment 2 to a dispensing lip 7 in cap 6. The cap 6 and attached first liquid compartment 2 fits inside second liquid compartment 10. The second liquid compartment 10 has a maximum liquid fill line 11 and has stabilizing feet 12 allowing the device to rest on a level surface if desired.

Figure 2:
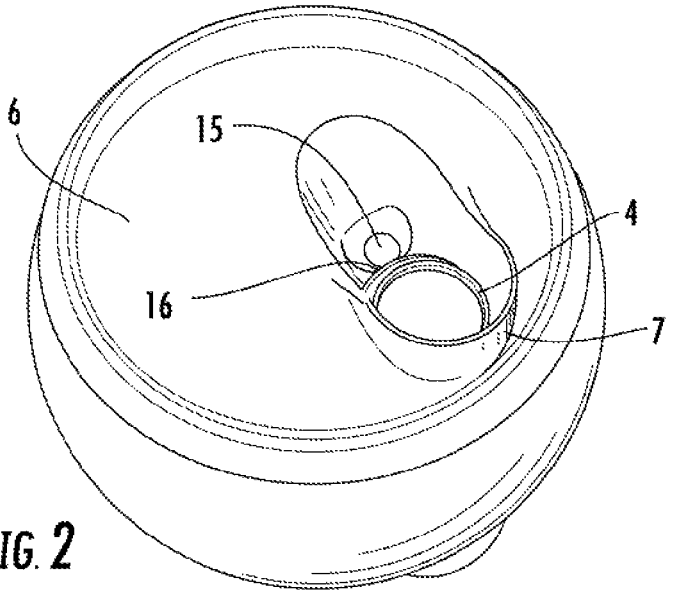
FIG. 2 is a perspective view of a lid with a dispensing lip.

FIG. 2 is a top view of a cap 6. The cap 6 has a second top opening 15 with a second top opening edge 16 positioned in cap 6 for delivering the second liquid to the dispensing lip 7 i.e. it is in fluid communication with the liquid in second liquid compartment 10. Note that the second top opening edge 16 is positioned higher than the first top opening edge 4 further adding in making sure all of any liquid in the first liquid compartment 2 is delivered before anything in the second liquid compartment 10 when delivering two liquids with the device. While the device is shown as clear, semi transparent or opaque material can be utilized as noted above for material choices.

Figure 3:
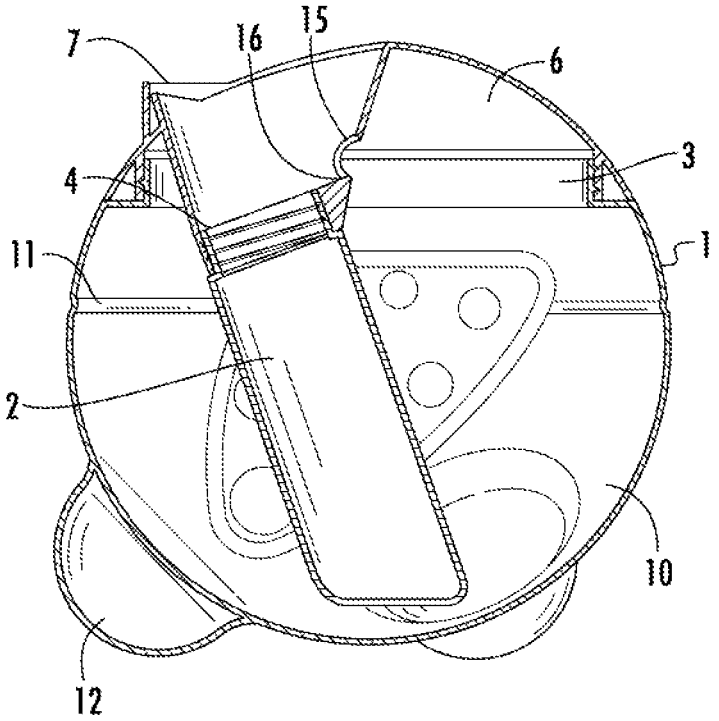
FIG. 3 is a cutaway view of an assembled device of the present invention.

FIG. 3 is a cutaway version of an embodiment of the present invention container 1 shown in an upright position. This clearly shows the angle of the first liquid compartment 2 and the position of the lips relative to one another in an upright position.

Figure 4:
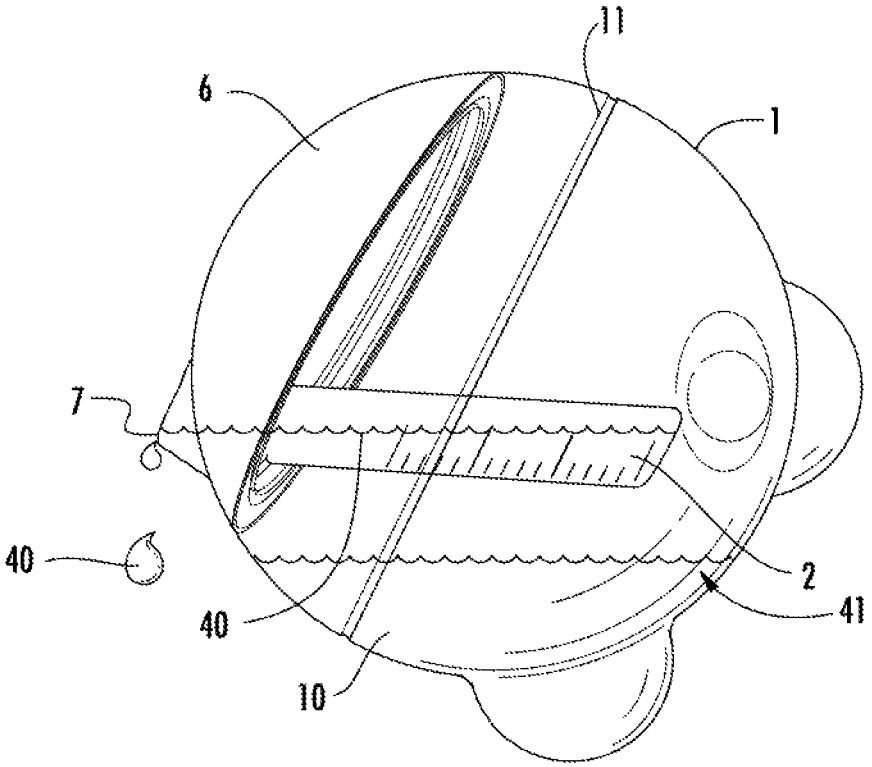
FIG. 4 is side view of the device of the present invention wherein each compartment is filled with a liquid and tipped to show the liquids emptying from the device.

FIG. 4 is a side perspective view of an embodiment of the present invention showing a first liquid 40 in the first liquid compartment 2 and a second liquid 41 in the second liquid compartment 10. The container is no longer upright and is being tipped in a tipping motion to dispense the liquids 40 and 41. As can be seen, the first liquid 40 is being dispensed into the air though this would normally be into a user's mouth, off of dispensing lip 7 and that the second liquid 41 will not be dispensed until first liquid 40 is finished being dispensed. It is noted in the embodiment that the second liquid compartment 10 completely surrounds the first liquid compartment 2.

Figure 5:
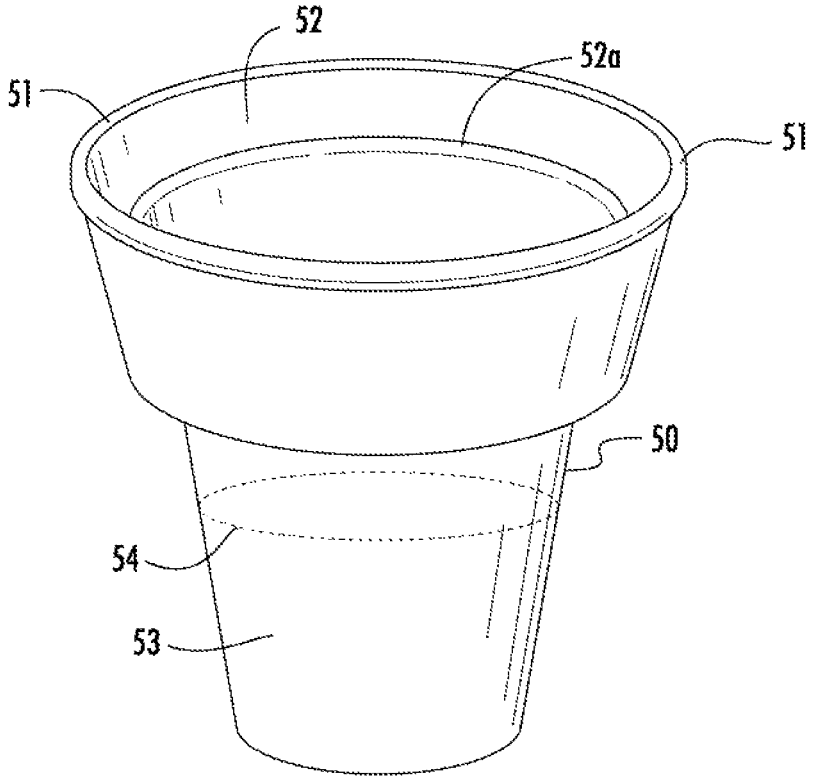
FIG. 5 is a perspective view of a circumferential first compartment.

FIG. 5 is a perspective view of a cup having a first compartment circumferentially placed with the second compartment below the first compartment. In this view, cup 50 has circumferential dispensing lip 51 and first compartment 52 has circumferential lip 52*a* concentric with dispensing lip 51 which forms part of the back wall of the compartment 52. The lower portion of cup 50 is similar to a standard plastic drinking cup to second compartment 53 having maximum fill line 54 which becomes the effective top of the compartment, at least for placement of a second liquid.

Figure 6:
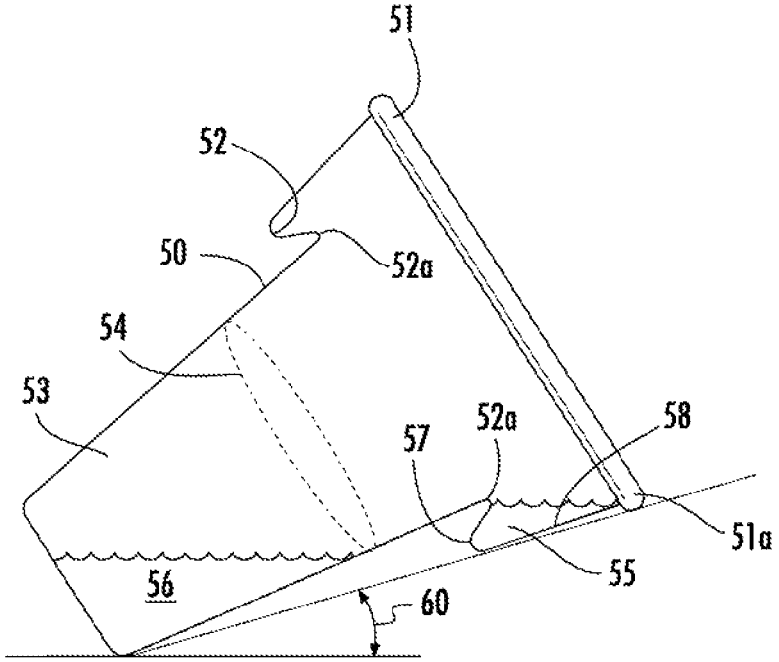
FIG. 6 is a cut through view of the cup on FIG. 5.

FIG. 6 is a cut through view of the cup shown in FIG. 5. In this view the first liquid 55 is in first compartment 52 wherein cup 50 is tilted at angle 60 for delivering to lip 51*a*. Circumferential lip 52*a* has angled wall 57 which forms the first compartment 52 with inner wall 58 of cup 50. Second liquid 56 is shown in second compartment 53. As can be seen on cup 50 is tilted liquid 55 that is delivered completely before second liquid 56 begins being delivered to dispensing lip 51*a*.

Figure 7:
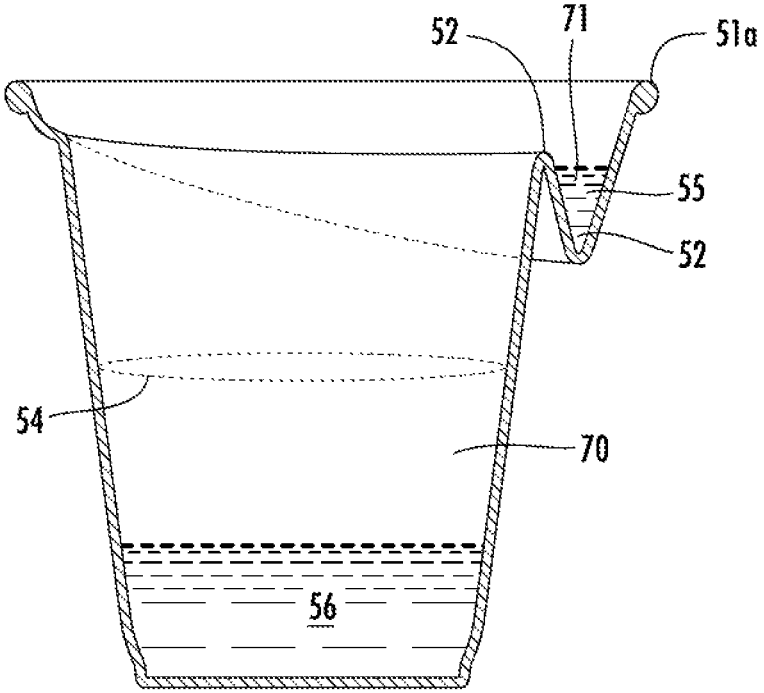
FIG. 7 is a partial circumferential first compartment.

FIG. 7 is a cut through view of a cup 70 similar to cup 50 but wherein the first compartment 71 holding first liquid 55 is only partially circumferential. The compartments are positioned next to each other.

Figure 8:
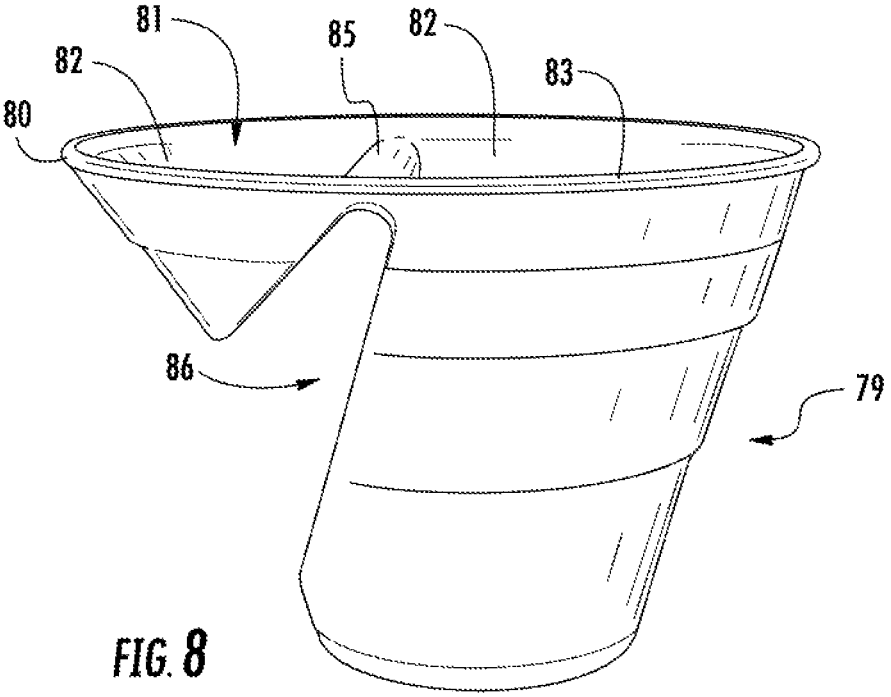
FIG. 8 is a side view of side-by-side compartments.

In FIG. 8 there is another embodiment of the present invention. There is a dispensing lip 80 in drink container 79 on the edge of first compartment 81. The first compartment 81 is positioned inside the container 79 and behind lip 80 and formed partially circumferentially to inner wall 82. The second liquid compartment 83 is positioned inside container 79 and next to (side-by-side) compartment 81 in fluid communication with compartment 81 when the container 79 is tipped towards dispensing lip 80 for dosing a first liquid from the first compartment. In this embodiment, compartments 81 and 83 are separated by a flexible joint 85 (plastic ridge or other flexible means) which allows compartment 81 to flex in the direction of arrow 86, thus lowering dispensing lip 80. This aids in making sure the first compartment 81 empties before compartment 83. One can flex the first compartment 81 with the fingers or with the mouth while drinking.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A drink container for delivering a first and second liquid in succession to a user in a single tipping motion comprising:

a. a dispensing lip;

b. a first liquid compartment for containing the first liquid, the compartment positioned behind the dispensing lip having a first top opening with a first top opening edge, the edge positioned in height below the dispensing lip for dispensing the first liquid to the dispensing lip;

c. a second liquid compartment for containing the second liquid, the compartment positioned at least partially surrounding the first liquid compartment and having a second top opening with a second top opening edge positioned behind the first opening edge and in height between the dispensing lip and the first top opening edge; and d. an indicator to indicate a maximum amount of the second liquid to place in the second liquid compartment to insure that the first liquid empties from the first liquid compartment at the dispensing lip before the second liquid begins to empty from the second liquid compartment.

2. The container according to claim 1 wherein the first liquid compartment is angled toward the dispensing lip.

3. The container according to claim 1 wherein the second liquid compartment entirely surrounds the first compartment sides.

4. The container according to claim 1 wherein there are feet on the bottom of the container.

5. The container according to claim 1 which further comprises a cap for covering one or both of the first and second liquid compartments.

6. The container according to claim 5 wherein the dispensing lip is on the cap.

7. The container according to claim 1 wherein the second top opening is about perpendicular to the first top opening.

8. A drink container for delivering a first and second liquid in succession to a user in a single tipping motion comprising:

a. a dispensing lip;

b. a first liquid compartment positioned inside the container for containing the first liquid, the first liquid compartment positioned below the dispensing lip and formed by an inner wall of the container and a connected lip positioned at least partially circumferentially to the inner wall; and c. a second liquid compartment positioned inside of the container in fluid communication with the dispensing lip when the container is tilted for delivery of the first liquid which further comprises an indicator to indicate a maximum amount of the second liquid to place in the second liquid compartment to insure that the first liquid compartment empties to the user before the second compartment begins to empty.

9. The container according to claim 8 wherein the first liquid compartment is circumferential to the dispensing lip.

10. The container according to claim 8 wherein the dispensing lip is circumferential to the top of the container.

11. The container according to claim 8 which is essentially cylindrical.

12. The container according to claim 8 which is a molded plastic cup.

13. The container according to claim 8 wherein the first compartment is positioned next to the second compartment.

14. The container according to claim 13 wherein there is a flexible joint between the first and second compartment which allows the first compartment to tile toward the second compartment and lower the position of the dispensing lip.

15. A drink container for delivering a first and second liquid in succession to a user in a single tipping motion comprising:

a. a dispensing lip;

b. a first liquid compartment positioned inside the container for containing the first liquid, positioned to deliver the first liquid to the dispensing lip; and c. a second liquid compartment positioned inside of the container for containing the second liquid, the compartment positioned at least partially surrounding the first liquid compartment which further comprises an indicator to indicate a maximum amount of the second liquid to place in the second liquid compartment to insure that the first liquid compartment empties to the user before the second compartment begins to empty.

* * * * *